US006933102B2

(12) United States Patent
Takahashi et al.

(10) Patent No.: US 6,933,102 B2
(45) **Date of Patent: *Aug. 23, 2005**

(54) SILVER HALIDE PHOTOGRAPHIC LIGHT-SENSITIVE MATERIAL

(75) Inventors: Kazutaka Takahashi, Kanagawa (JP); Terukazu Yanagi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 37 days.

This patent is subject to a terminal disclaimer.

(21) Appl. No.: 09/962,078

(22) Filed: Sep. 26, 2001

(65) Prior Publication Data

US 2002/0058215 A1 May 16, 2002

(30) Foreign Application Priority Data

Sep. 28, 2000 (JP) ..... P.2000-297200

(51) Int. Cl.[7] ..... G03C 1/035; G03C 1/015

(52) U.S. Cl. ..... 430/567; 430/568; 430/569; 430/599; 430/600; 430/607

(58) Field of Search ..... 430/567, 568, 430/569, 599, 600, 607

(56) References Cited

U.S. PATENT DOCUMENTS 4,434,226 A * 2/1984 Wilgus et al. ..... 430/567
4,983,508 A * 1/1991 Ishiguro et al. ..... 430/567
5,411,851 A * 5/1995 Maskasky ..... 430/569
5,536,630 A * 7/1996 Bagchi et al. ..... 430/567
5,654,133 A * 8/1997 Oikawa ..... 430/567
5,928,852 A * 7/1999 Ohzeki ..... 430/567
5,928,853 A * 7/1999 Yamamoto ..... 430/569
5,985,535 A * 11/1999 Urabe ..... 430/569
5,985,536 A * 11/1999 De Keyzer et al. ..... 430/605
5,998,114 A * 12/1999 Bringley et al. ..... 430/506
6,395,464 B1 * 5/2002 Suzuki et al. ..... 430/567
6,521,401 B1 * 2/2003 Yamashita et al. ..... 430/584
6,528,243 B2 * 3/2003 Koide et al. ..... 430/543
6,534,257 B2 * 3/2003 Kikuchi ..... 430/567
6,593,071 B2 * 7/2003 Kondo et al. ..... 430/567
2002/0155399 A1 * 10/2002 Urabe et al. ..... 430/567

FOREIGN PATENT DOCUMENTS

EP 503700 * 9/1992
JP 10-104769 4/1998 ..... G03C/1/015

* cited by examiner

*Primary Examiner*—Amanda Walke
(74) *Attorney, Agent, or Firm*—Sughrue Mion, PLLC

(57) ABSTRACT

A silver halide photographic light-sensitive material is disclosed, comprising at least one silver halide emulsion characterized in that 50% or more of the projected area of all silver halide grains comprises tabular silver halide grains satisfying all of the following requirements (i) to (iii) and the coefficient of variation in the thickness of the tabular silver halide grains is less than 40%: (i) to have a grain thickness of less than 0.05 μm and an equivalent-circle diameter of 0.6 μm or more; (ii) to be silver iodobromide or silver chloroiodobromide having a silver bromide content of 70 mol % or more; (iii) to be a tabular silver halide grain having two parallel main planes comprising a (111) face.

6 Claims, 2 Drawing Sheets

SILVER HALIDE PHOTOGRAPHIC LIGHT-SENSITIVE MATERIAL

FIELD OF THE INVENTION

The present invention relates to a silver halide photographic light-sensitive material using a silver halide (hereinafter referred to as "AgX") emulsion.

BACKGROUND OF THE INVENTION

A tabular silver halide grain (hereinafter referred to as a "tabular grain") has the following photographic properties:

1) the ratio of surface area to volume (hereinafter referred to as a "specific surface area") is large and a large amount of sensitizing dye can be adsorbed to the surface, so that the color sensitization sensitivity is relatively high as compared with the intrinsic sensitivity;

2) when an emulsion containing tabular grains is coated and dried, the grains are oriented in parallel, so that the coated layer can be reduced in the thickness and the photographic light-sensitive material obtained can have good sharpness;

3) in an X-ray photographic system, when a sensitizing dye is added to the tabular grain, the silver halide cross-over light can be extremely reduced and therefore, the deterioration of image quality can be prevented;

4) light scattering is reduced and therefore, an image can be obtained with high resolution;

5) the sensitivity to blue light is low and therefore, when tabular grains are used in a green-sensitive layer or a red-sensitive layer, a yellow filter can be removed from the emulsion.

By virtue of these advantageous properties, tabular grains have been heretofore used in commercially available light-sensitive materials.

JP-B-6-44132 (the term "JP-B" as used herein means an "examined Japanese patent publication") and JP-B-5-16015 disclose a tabular grain emulsion having an aspect ratio of 8 or more. The aspect ratio as used herein means a ratio of the diameter to the thickness of a tabular grain. The diameter of a grain as used herein means the diameter of a circle having an area equal to the projected area of a grain when the emulsion is observed through a microscope or an electron microscope. The thickness is shown by the distance between two parallel main surfaces constituting a tabular silver halide.

JP-B-4-36374 discloses a color photographic light-sensitive material which is improved in the sharpness, sensitivity and graininess by using tabular grains having a thickness of less than 0.3 $\mu$m and a diameter of 0.6 $\mu$m or more in at least one layer of green-sensitive emulsion layer and red-sensitive emulsion layer.

In recent years, with the progress of silver halide light-sensitive materials designed to higher sensitivity and smaller format, a color light-sensitive material having higher sensitivity and improved image quality is keenly demanded. To meet with this requirement, the silver halide emulsion is demanded to have higher sensitivity and more excellent graininess. Conventional tabular silver halide emulsions cannot cope with these requirements and more improvement of the performance is being demanded.

As the aspect ratio of a tabular grain is larger, the specific surface area is larger and the above-described advantageous properties of a tabular grain can be more effectively used. In other words, a larger number of sensitizing dyes are adsorbed to a larger surface area and a larger amount of light is absorbed per one grain, whereby higher sensitivity can be obtained. Therefore, many studies have been heretofore made to prepare tabular grains reduced in the thickness. JP-B-5-12696 discloses a method of oxidizing and thereby ineffectuating a methionine group in gelatin and preparing thin tabular grains using the gelatin as a dispersion medium, JP-A-8-82883 (the term "JP-A" as used herein means an "unexamined published Japanese patent application") discloses a method of ineffectuating the amino group and the methionine group in gelatin and preparing thin tabular grains using the gelatin as a dispersion medium, and JP-A-10-148897 discloses method of chemically modifying the amino group in gelatin to introduce at least two or more carboxyl groups and preparing thin tabular grains using the gelatin as a dispersion medium.

Tabular grains are preferably prepared by a method of performing the nucleation and/or growth by adding silver halide fine grains to the reactor holding an aqueous solution of protective colloid in place of adding an aqueous silver salt solution and an aqueous halide solution. The techniques on this method is disclosed in U.S. Pat. No. 4,879,208, JP-A-1-183644, JP-A-2-44335, JP-A-2-43535 and JP-A-2-68538. Also, a method for producing an ultrathin tabular grain emulsion having an average thickness of less than 0.07 $\mu$m is disclosed in EP-A-507701 and JP-A-10-239787. According to this production method, a mixing vessel is provided outside a reactor for performing the nucleation and/or grain growth of silver halide grains, an aqueous silver salt solution and an aqueous halide solution are fed to and mixed in the mixing vessel to form silver halide fine grains, and the formed fine grains are immediately fed to the reactor to perform nucleation and/or grain growth in the reactor. The ultrafine grains produced in the mixing vessel are, after the introduction into the reactor, scattered within the reactor by stirring and due to the fine grain size, the grains readily dissolve to release silver ion and halide ion and thereby cause uniform nucleation and/or growth. That is, tabular grains having high uniformity and a small thickness can be produced. In the above-described patent publications, examples describing the preparation of tabular grains are set forth, where the average tabular thickness is at least 0.042 $\mu$m and the aspect ratio is at most 40.

JP-A-7-230133, JP-A-8-87087 and JP-A-8-87088 disclose a method of producing an ultrathin tabular grain emulsion having a tabular thickness of less than 0.07 $\mu$m and an AgBr content of 50 mol % or more. According to this production method, a growth-controlling agent (triaminopyrimidine, 5,7-diiodo-8-hydroquinoline or a phenol having two iodine substituents) is added at the growth of tabular grains and thereby the tabular grains are grown while keeping the small thickness.

JP-A-10-104769 discloses a method for producing an ultrathin tabular grain emulsion having a tabular thickness of 0.01 to 0.3 $\mu$m and an AgBr content of 60 mol % or more. According to this production method, a growth-controlling agent (a compound containing one or more heterocyclic nitrogen quaternary base compound within one molecule) is added before the formation of tabular grains and thereby tabular grains having a small thickness are formed.

The technique for obtaining a high aspect ratio and the use of a growth-controlling agent are accompanied by a serious problem in that the coefficient of variation in the tabular thickness increases due to coalescence of tabular grains with each other. The coalescence means a phenomenon such that two or more tabular grains gather to form a secondary particle. When the coalescence takes place, reduction in the photographic performance is caused, specifically, deterioration of graininess, reduction in the concentration after development, increase in fogging and softening of photographic properties. The coalescence is a phenomenon of causing cohesion between main surfaces of tabular grains and this occurs more readily as the aspect ratio is higher and the amount of the growth-controlling agent adsorbed is larger, namely, the coverage of the adsorbed growth-controlling agent on the grain surface is higher.

SUMMARY OF THE INVENTION

The object of the present invention is to provide a silver halide photographic light-sensitive material using a silver halide emulsion comprising very thin tabular silver halide grains where the main surface having a smaller coefficient of variation in the thickness is a (111) face.

The object of the present invention has been attained by the following techniques.

(1) A silver halide photographic light-sensitive material comprising at least one silver halide emulsion characterized in that 50% or more of the projected area of all silver halide grains comprises tabular silver halide grains satisfying all of the following requirements (i) to (iii) and the coefficient of variation in the thickness of the tabular silver halide grains is less than 40%:

(i) to have a grain thickness of less than 0.05 μm and an equivalent-circle diameter of 0.6 μm or more;

(ii) to be silver iodobromide or silver chloroiodobromide having a silver bromide content of 70 mol % or more;

(iii) to be a tabular silver halide grain having two parallel main planes comprising a (111) face.

(2) The silver halide photographic light-sensitive material as described in (1), wherein the coefficient of variation in the thickness of the tabular silver halide grains is less than 30%.

(3) The silver halide photographic light-sensitive material as described in (1), wherein the coefficient of variation in the thickness of the tabular silver halide grains is less than 20%.

(4) The silver halide photographic light-sensitive material as described in any one of (1) to (3), wherein the average equivalent-circle diameter of the tabular silver halide grains is 1.0 μm or more.

(5) The silver halide photographic light-sensitive material as described in any one of (1) to (4), wherein the tabular silver halide grains are produced by a method characterized in that a crystal habit-controlling agent comprising a compound selected from the compounds represented by the following formulae (I), (II) and (III) is not present in the reactor at the time of nucleation but is allowed to be present in the reactor at the time of physical ripening and growing:

(I)

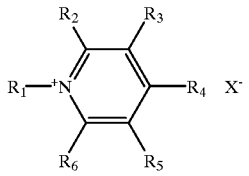

wherein $R_1$ represents an alkyl group, an alkenyl group or an aralkyl group, $R_2$, $R_3$, $R_4$, $R_5$ and $R_6$ each represents a hydrogen atom or a substituent, each of the pairs $R_2$ and $R_3$, $R_3$ and $R_4$, $R_4$ and $R_5$, and $R_5$ and $R_6$ may form a condensed ring, provided that at least one of $R_2$, $R_3$, $R_4$, $R_5$ and $R_6$ represents an aryl group, and $X^-$ represents a counter anion;

(II)

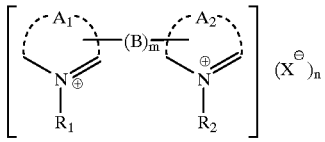

(III)

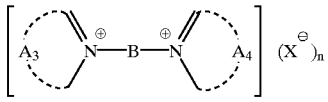

wherein $A_1$, $A_2$, $A_3$ and $A_4$, which may be the same or different, each represents a nonmetallic atom group necessary for completing the nitrogen-containing heterocyclic ring, B represents a divalent linking group, m represents 0 or 1, $R^1$ and $R^2$ each represents an alkyl group, X represents an anion, and n represents 0, 1 or 2, provided that when an inner salt is formed, n is 0 or 1.

(6) The silver halide photographic light-sensitive material as described in any one of (1) to (5), wherein the tabular silver halide grain is produced by a method characterized in that the nucleation and/or growth is performed by feeding a silver halide fine grain emulsion to the reactor.

(7) The silver halide photographic light-sensitive material as described in any one of (1) to (6), wherein the tabular silver halide grains are produced in the presence of a lime-processed ossein gelatin satisfying the requirement (a):

(a) the high molecular weight components having a molecular weight of about 280,000 or more occupy from 5 to 50% and the low molecular weight components having a molecular weight of about 100,000 or less occupy 55% or less.

Figure 1:
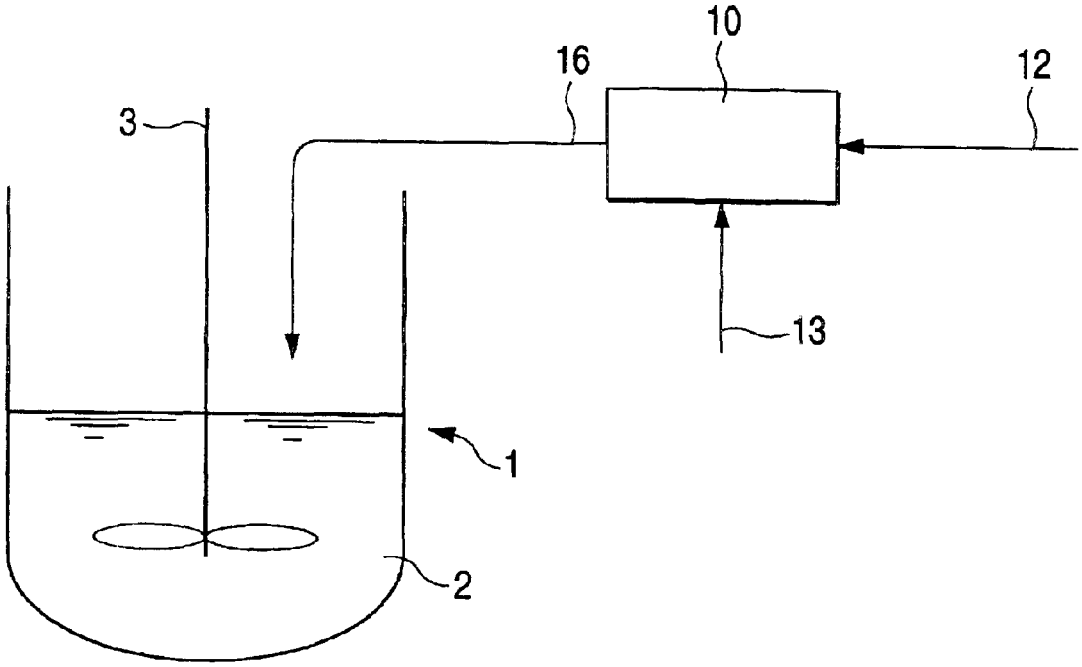
FIG. 1 is a schematic cross section roughly showing the construction of the practical embodiment.

1 reactor
2 aqueous solution of protective colloid
3 stirring blade
10 mixing vessel
12, 13 liquid feed port
16 liquid discharge port

DETAILED DESCRIPTION OF THE INVENTION

The tabular silver halide grain for use in the present invention is a grain satisfying all of the requirements (i) to (iii) in claim 1. The tabular silver halide grain (hereinafter referred to as "tabular grain") as used in the present invention means a grain having two opposing parallel main surfaces, where the equivalent-circle diameter of the main surface (diameter of a circle corresponding to a circle having the same projected area as the main surface) is 10 times larger than the distance between main surfaces (namely, the thickness of a grain). In the present invention, the coefficient of variation in the thickness of tabular grains is less than 40%, preferably less than 30%, more preferably less than 20%, still more preferably less than 15%. The coefficient of variation as used herein means a value determined by dividing the standard deviation of the tabular thickness by an average tabular thickness and multiplying the obtained value by 100.

The average grain diameter/grain thickness ratio of the emulsion comprising tabular grains for use in the present invention is preferably from 30 to 500, more preferably from 50 to 500. The average grain diameter/grain thickness ratio may be obtained by averaging the grain diameter/thickness ratios of all tabular grains but as a simple method, a ratio of the average diameter of all tabular grains to the average thickness of all tabular grains may also be used therefor.

The (equivalent-circle) diameter of a tabular grain for use in the present invention is 0.6 μm or more, preferably 0.8 μm or more, more preferably 1.0 μm or more. The upper limit is not particularly limited but is preferably 20 μm or less. The grain thickness is less than 0.05 μm, preferably less than 0.04 μm, more preferably from 0.03 to 0.01 μm.

The coefficient of variation in the equivalent-circle diameter of tabular grains for use in the present invention is 30% or less, preferably 20% or less, more preferably 15% or less.

The grain diameter and the grain thickness for use in the present invention can be measured and determined using an electron microphotograph of a grain according to the method described in U.S. Pat. No. 4,434,226. More specifically, the grain thickness can be easily determined by depositing a metal together with a latex for control on a grain from the oblique direction, measuring the length of the shadow thereof on an electron microphotograph and calculating the thickness by referring to the length of the shadow of the latex.

The tabular grain is roughly classified into those having a (111) main surface and those having a (100) main surface. The tabular grain for use in the present invention is a tabular grain having at least one (111) twin plain and a (111) main surface in parallel to the twin plain. The twin plain means such a (111) face that ions at all lattice points on both surfaces of the (111) face are in the relationship of a mirror image. The tabular grain for use in the present invention may be a triangular grain or a hexagonal grain. The triangular tabular grain has a completely triangular form or a hexagonal form and in the case of hexagonal form, the grain is a tabular grain where the ratio in the length between adjacent long and short sides is 5:1 or more and when a three-fold rotation asymmetry is not established in the hexagonal form, a tabular grain where the ratio of the average length of three pairs of long sides to the average length of three pairs of short sides is 5:1 or more. The hexagonal tabular grain is a tabular grain where the ratio in the length between adjacent long and short sides of a hexagon is 5:1 or less and when a three-fold rotation asymmetry is not established, a tabular grain where the ratio of the average length of three pairs of long sides to the average length of three pairs of short sides is 5:1 or less.

The halogen composition of the tabular grain is silver iodobromide or silver chloroiodobromide having a silver bromide content of 70 mol % or more. The structure relating to the halogen composition of a tabular grain for use in the present invention can be confirmed by combining X-ray diffraction, the EPMA (sometimes also called XMA) method (a method of scanning a silver halide grain with an electron beam to detect the silver halide composition), the ESCA method (a method of irradiating an X-ray and spectro-analyzing photoelectrons coming out from the grain surface) or the like.

In the silver halide emulsion according to the present invention, the silver iodide content is preferably uniform as much as possible among silver halide grains. That is, the coefficient of variation in the silver iodide content of the silver halide emulsion is preferably 30% or less, more preferably 20% or less.

The tabular grains for use in the present invention are preferably prepared by a method of performing the nucleation and/or growth while adding silver halide fine grains in place of adding an aqueous silver salt solution and an aqueous halide solution to the reactor holding an aqueous solution of protective colloid. The technique on this method is disclosed in U.S. Pat. No. 4,879,208, JP-A-1-183644, JP-A-2-44335, JP-A-2-43535 and JP-A-2-68538. In the formation of tabular grains, a fine grain silver iodide emulsion (grain size: 0.1 μm or less, preferably 0.06 μm or less) emulsion may be added as means for feeding iodide ion. At this time, the production method disclosed in U.S. Pat. No. 4,879,208 is preferably used as the means for feeding silver iodide fine grains. In such a method of performing the nucleation and/or grain growth by the addition of fine grains, the silver halide fine grains added to the reactor to prepare silver halide grains are preferably prepared by a method of providing a stirring blade having no rotation axis passing through a stirring tank and rotation-driving the stirring blade within the stirring tank disclosed in JP-A-10-239787 and JP-A-11-76783.

In the present invention, an aqueous silver salt solution and an aqueous halide solution may be added to the mixing vessel for forming silver halide grains by a method of adding each solution at a constant rate or a method of adding an aqueous silver salt solution and/or an aqueous halide solution while increasing or decreasing the addition rate, the amount added and the concentration at the addition. Respective solutions may be added continuously or intermittently. The concentration of the aqueous silver salt solution and/or aqueous halide solution is preferably from 0.001 to 2.5 mol/liter, more preferably from 0.01 to 1 mol/liter. Furthermore, the pulsation of each solution is preferably small. The pulsation means that the flow rate fluctuates in a short period of time. The instantaneous fluctuation of the flow rate (=(maximum value−minimum value)/average flow rate) is preferably 4% or less, more preferably 2% or less, still more preferably 1% or less.

In the present invention, the gelatin used as a protective colloid for the silver halide fine grains may be an alkali-treated gelatin or an acid-treated gelatin, but an alkali-treated gelatin is usually used. In particular, an alkali-treated gelatin subjected to a deionization treatment or an ultrafiltration treatment to remove impurity ion or impurities is preferably used. Other than the alkali-treated gelatin, examples of the gelatin which can be used include acid-treated gelatin, phthalated gelatin obtained by substituting the amino group of gelatin, succinated gelatin, trimellitated gelatin, phenylcarbamyl gelatin, derivative gelatin such as esterified gelatin obtained by substituting the carboxyl group of an aliphatic hydrocarbon having from 4 to 16 carbon atoms or gelatin, low molecular weight gelatin having a molecular weight of 1,000 to 80,000 (specific examples thereof include enzyme-decomposed gelatin, acid and/or alkali hydrolysate gelatin, thermally decomposed gelatin and ultrasonically decomposed gelatin), high molecular weight gelatin having a molecular weight of 110,000 to 300,000, gelatin having a methionine content of 50 μmol/g or less, gelatin having a thyrosine content of 30 μmol/g or less, oxidation treated gelatin, and gelatin with methionine being inactivated by alkylation. These may be used in combination of two or more thereof. In order to form finer silver halide fine grains in the mixing vessel, the temperature in the mixing vessel must be kept low, however, since gelatin readily coagulates at 35° C. or less, a low molecular weight gelatin of causing no coagulation even at low temperatures is preferably used. The molecular weight of the low molecular weight gelatin is 50,000 or less, preferably 30,000 or less, more preferably 10,000 or less. A synthetic polymer having an activity as a protective colloid of silver halide grains does not coagulate even at low temperatures and therefore, can also be used in the present invention. Other than gelatin, a natural polymer may also be used in the present invention and this is described in JP-B-7-111550 and *Research Disclosure*, Item IX, Vol. 176, No. 17643 (December, 1978).

The compounds represented by formulae (I), (II) and (III) used at the formation of (111) main surface-type tabular grains in the present invention are described in detail below.

In formula (I), $R_1$ is preferably a linear, branched or cyclic alkyl group having from 1 to 20 carbon atoms (e.g., methyl, ethyl, isopropyl, tert-butyl, n-octyl, n-decyl, n-hexadecyl, cyclopropyl, cyclopentyl, cyclohexyl), an alkenyl group having from 2 to 20 carbon atoms (e.g., allyl, 2-butenyl, 3-pentenyl) or an aralkyl group having from 7 to 20 carbon atoms (e.g., benzyl, phenethyl). Each group represented by $R_1$ may be substituted. Examples of the substituent include the substituents having the same meaning as the substitutable group represented by $R_2$ to $R_6$ which are described below.

$R_2$, $R_3$, $R_4$, $R_5$ and $R_6$, which may be the same or different, each represents a hydrogen atom or a group substitutable therefor. Examples of the substitutable group include a halogen atom, an alkyl group, an alkenyl group, an alkynyl group, an aralkyl group, an aryl group, a heterocyclic group (e.g., pyridyl, furyl, imidazolyl, piperidyl, morpholino), an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an acyl group, an acyloxy group, a phosphoric acid amide, an alkylthio group, an arylthio group, a cyano group, a sulfo group, a carboxy group, a hydroxy group, a phosphono group, a nitro group, a sulfino group, an ammonio group (e.g., trimethylammonio), a phosphonio group and a hydrazino group. These groups each may further be substituted.

Each of the pairs $R_2$ and $R_3$, $R_3$ and $R_4$, $R_4$ and $R_5$, and $R_4$ and $R_6$ may be condensed to form a quinoline ring, an isoquinoline ring or an acridine ring. The substituents $R_2$, $R_3$, $R_4$, $R_5$ and $R_6$ each has from 1 to 20 carbon atoms.

$X^-$ represents a counter anion. Examples of the counter anion include halide ion (e.g., chloride ion, bromide ion), nitrate ion, sulfate ion, p-toluenesulfonate ion and trifluoromethanesulfonate ion.

In a preferred embodiment of formula (I), $R_1$ represents an aralkyl group and at least one of $R_2$, $R_3$, $R_4$, $R_5$ and $R_6$ represents an aryl group.

In a more preferred embodiment of formula (I), $R_1$ represents an aralkyl group, $R_4$ represents an aryl group, and $X^-$ represents a halide ion. Examples of these compounds include Crystal Habit-Controlling Agents 1 to 29 described in EP-A-723187, however, the present invention is not limited thereto.

The compounds represented by formulae (II) and (III) for use in the present invention are described in detail below.

$A_1$, $A_2$, $A_3$ and $A_4$ each represents a nonmetallic element for completing the nitrogen-containing heterocyclic ring and may contain an oxygen atom, a nitrogen atom or a sulfur atom or may be condensed with a benzene ring. The heterocyclic rings constituted by $A_1$, $A_2$, $A_3$ and $A_4$ each may have a substituent or may be the same or different. Examples of the substituent include an alkyl group, an aryl group, an aralkyl group, an alkenyl group, a halogen atom, an acyl group, an alkoxycarbonyl group, an aryloxycarbonyl group, a sulfo group, a carboxy group, a hydroxy group, an alkoxy group, an aryloxy group, an amide group, a sulfamoyl group, a carbamoyl group, a ureido group, an amino group, a sulfonyl group, a cyano group, a nitro group, a mercapto group, an alkylthio group and an arylthio group. $A_1$, $A_2$, $A_3$ and $A_4$ each preferably represents a 5- or 6-membered ring (e.g., pyridine ring, imidazole ring, thiazole ring, oxazole ring, pyrazone ring, pyrimidine ring), more preferably a pyridine ring.

B represents a divalent linking group. The divalent linking group includes those constituted by using individually or in combination an alkylene group having from 1 to 18 carbon atoms, an arylene group having from 6 to 18 carbon atoms, an alkenylene group having from 1 to 18 carbon atoms, —$SO_2$—, —SO—, —O—, —S—, —CO—and —N(R')— (wherein R' represents an alkyl group, an aryl group or a hydrogen atom). B is preferably alkylene or alkenylene.

$R^1$ and $R^2$ each represents an alkyl group having from 1 to 20 carbon atoms and $R^1$ and $R^2$ may be the same or different.

The alkyl group includes a substituted or unsubstituted alkyl group and examples of the substituent are the same as those described as the substituent of $A_1$, $A_2$, $A_3$ and $A_4$.

$R^1$ and $R^2$ each preferably represents an alkyl group having from 4 to 10 carbon atoms, preferably a substituted or unsubstituted aryl-substituted alkyl group. X represents an anion, for example, chloride ion, bromide ion, iodide ion, nitrate ion, sulfate ion, p-toluenesulfonate or oxalate. n represents 0 or 1 and when an inner salt is formed, n is 0.

Specific examples of the compounds represented by formulae (II) and (III) include those disclosed in JP-A-2-32 (Compounds 1 to 42), however, the present invention is not limited to these compounds.

The compounds represented by formulae (I), (II) and (III) each is very strong in the property of selectively adsorbing to the (111) face of a silver halide crystal and called a (111) crystal habit-controlling agent. When such a compound is allowed to be present during formation of (111) main surface-type tabular grains, the compound selectively adsorbs to the main surface of a tabular grain and prevent the growth of the tabular grain in the thickness direction, as a result, thin tabular grains can be obtained. JP-A-10-104769 discloses a technique of preparing thin tabular grains by using a (111) face crystal habit-controlling agent at the nucleation (formation of twins), however, in the present invention, the (111) crystal habit-controlling agent is not allowed to be present at the time of nucleation but is allowed to exist at the time of ripening and grain growth. More specifically, the (111) crystal habit-controlling agent is added after the completion of nucleation or at the time of ripening subsequent to the nucleation. It is also preferred that the (111) crystal habit-controlling agent is present at the growth of tabular grains and if desired, the (111) crystal habit-controlling agent is preferably added before the initiation of growth or during the growth. The (111) crystal habit-controlling agent is more preferably added continuously at the growth time of tabular grains.

The amount added of the compound represented by formula (I), (II) or (III) for use in the present invention is from $5\times10^{-4}$ to $10^{-1}$ mol, more preferably from $10^{-3}$ to $5\times10^{-2}$ mol, per mol of silver halide.

In the present invention, the gelatin used as a protective colloid of the tabular grain emulsion may be an alkali-treated gelatin or an acid-treated gelatin but an alkali-treated gelatin is usually used. The alkali-treated gelatin is composed by, based on the molecular weight, sub-α (low molecular weight), α (molecular weight: about 100,000), β (molecular weight: about 200,000), γ (molecular weight: about 300,000), void (high molecular weight) and the like. In particular, an alkali-treated gelatin subjected to a deionization treatment or an ultrafiltration treatment to remove impurity ion or impurities is preferably used. Other than the alkali-treated gelatin, examples of the gelatin which can be used include acid-treated gelatin, phthalated gelatin obtained by substituting the amino group of gelatin, succinated gelatin, trimellitated gelatin, phenylcarbamyl gelatin, derivative gelatin such as esterified gelatin obtained by substituting the carboxyl group of an aliphatic hydrocarbon having from 4 to 16 carbon atoms or gelatin, low molecular weight gelatin having a molecular weight of 1,000 to 80,000 (specific examples thereof include enzyme-decomposed gelatin, acid and/or alkali hydrolysate gelatin, thermally decomposed gelatin and ultrasonically decomposed gelatin), high molecular weight gelatin having a molecular weight of 110,000 to 300,000, gelatin having a methionine content of 50 μmol/g or less, gelatin having a thyrosine content of 30 μmol/g or less, oxidation treated gelatin, and gelatin with methionine being inactivated by alkylation. These may be used in combination of two or more thereof.

In order to improve the coalescence of tabular grains with each other and thereby reduce the coefficient of variation in the tabular thickness, it is necessary to increase the thickness of gelatin film adsorbed to a tabular grain and strengthen the adsorbing power of gelatin. In this meaning, a high molecular weight gelatin is preferably used. Particularly, when the (111) crystal habit-controlling agent is used and the aspect ratio is increased, the coalescence of tabular grains seriously proceeds and therefore, use of a high molecular weight gelatin is effective for reducing the coefficient of variation in the tabular thickness. The high molecular weight gelatin preferably has a construction such that the high molecular weight components having a molecular weight of 280,000 or more occupy from 5 to 50% and the low molecular weight components having a molecular weight of about 100,000 or less occupy 55% or less, more preferably such that the high molecular weight components having a molecular weight of 280,000 or more occupy from 5 to 40% and the low molecular weight components having a molecular weight of about 100,000 or less occupy 50% or less.

The molecular weight of the gelatin is measured as follows.

Into 50 mL-conical flask, 0.4 g of gelatin as a sample is introduced, and thereto 20 ml of an eluting solution (i.e., a mixing solution of 100 mm potassium dihydrogenphosphate, 100 mM sodium dihydrogenphosphate, etc.) is added using a measuring pipette. After swelling for one hour, the mixing solution is heated for one hour in a 50° C.-thermostat to dissolve. Further, the resulting solution is diluted with the eluting solution to 10 times and then filtered off with a 0.45 μm-filter.

The obtained sample is injected into a 100 μL-column to measure the GPC, provided that Shodex Asahipak GS-620 7G is used as the column and the detection is carried out with UV-230 nm (RANGE 0.04).

The technique on the high molecular weight gelatin is disclosed in JP-A-11-237704 and Japanese Patent Application Nos. 2000-48166 and 2000-95146, the amount of gelatin used in the process of forming grains is from 1 to 60 g/mol-Ag, preferably from 3 to 40 g/mol-Ag. In the present invention, the concentration of gelatin in the process of chemical sensitization is preferably from 1 to 100 g/mol-Ag, more preferably from 1 to 70 g/mol-Ag.

The production process of gelatin in general is well known and described, for example, in T. H. James, *The Theory of the Photographic Process,* 4th ed. Macmillan, page 55 (1977), *Kagaku Shashin Binran* (*jo*) (*Handbook of Scientific Photography* (*first half*)), pp. 72–75, Maruzen, Shinichi Kikuchi, *Shashin Kagaku* (*Photographic Chemistry*), page 213, Kyoritsu Shuppan (1976), and Shiro Akahori and Saburo Mizushima (compiler), *Tanpakushitsu Kagaku* (*Protein Chemistry*), page 453, Kyoritsu Shuppan (1955).

For example, the alkali-treated gelatin is produced by removing calcium of the starting material bone or skin, dipping the resulting material in lime to untie the collagen structure, extracting it with warm water, and concentrating and drying the extract. In the extraction, the number of extraction plates is generally from 1 to 7 stages and the extraction temperature is elevated as the extraction plate is higher.

The production method of gelatin, which can be used in the present invention, is roughly classified into the following two groups.

1. Method of Performing No Crosslinking of Gelatin:

For example, the following methods may be used.

Production Method [1]:

After the extraction by the extraction operation in the above-described production method, the gelatin extract in the extraction initial stage is eliminated using the gelatin extract in the later stage.

Production Method [2]:

In the above-described production method, the treatment temperature in the production process from extraction to drying is set to less than 40° C.

Production Method [3]:

A gelatin gel is dialyzed with cold water (15° C.) [see, *The Journal of Photographic Science*, Vol. 23, page 33 (1975)].

Production Method [4]:

A fractionation using an isopropyl alcohol [see, *Discussions of the Faraday Society*, Vol. 18, page 288 (1954)].

By using these production methods individually or in combination, the gelatin for use in the present invention can be obtained.

2. Method of Gelatin Crosslinking Agent:

The gelatin for use in the present invention is preferably controlled in the molecular weight distribution by crosslinking the gelatin. The crosslinking method includes the following two methods, a method of crosslinking gelatin molecules with each other using an enzyme and a method of adding a crosslinking agent to allow the crosslinking agent to form a chemical bond between gelatin molecules and thereby cross-link the gelatin molecules.

In the enzymatic method for use in the present invention, the gelatin is crosslinked representatively by transglutaminase and this is described below. The transglutaminase can crosslink the gelatin using its function of catalyzing an acyl transfer reaction between a γ-carboxyamide group in the glutamine residue of gelatin as a protein and a primary amine of various types. The transglutaminase includes those originated in animals, those originated in plants and those originated in microorganisms. For example, the animal origin product includes those extracted from internal organs or blood of mammals, such as liver of a guinea pig, the plant origin product includes those extracted from a pea, and the microorganism origin product includes those extracted from a ray fungus. In the present invention, transglutaminase of any origin may be used insofar as it exhibits the transglutaminase activity.

In addition, those synthesized by, for example, the method described in Clark et al., *Achieves of Biochemistry and Biophysics,* 79, 338 (1959), the method described in Connel et al., *J. Biological Chemistry,* 246 (1971), the method described in JP-A-4-207149 or the method described in JP-A-6-30770, may also be preferably used as the transglutaminase for use in the present invention. Examples of these transglutaminases include ACTEBA (a trade name, produced by Ajinomoto K. K.). The transglutaminase activity for use in the present invention can be measured by reacting benzyloxycarbonyl L-glutaminyl glycine with hydroxyamine and determining the amount of hydroxamic acid produced. In this measurement, the transglutaminase activity of producing $1\times10^{-6}$ mol of hydroxamic acid per 1 minute is designated as 1 unit. The transglutaminase for use in the present invention is preferably added in an amount of producing, though this may vary depending on the gelatin used, $1\times10^{-6}$ mol or more of hydroxamic acid per 1 g of gelatin to control the molecular weight distribution.

In the method of crosslinking gelatin using a crosslinking agent, all crosslinking agents heretofore known as a hardening agent for gelatin can be used. Representative compounds thereof are described below.

A. Inorganic Crosslinking Agent (Inorganic Hardening Agent)

Cationic chromium complexes (examples of the ligand for the complex include hydroxyl group, oxalic acid group, citric acid group, malonic acid group, lactate, tartrate, succinate, acetate, formate, sulfate, chloride and nitrate);

Aluminum salts (particularly sulfate, potassium alum and aluminum alum; these compounds crosslink the carboxyl group of gelatin);

B. Organic Crosslinking Agent (Organic Hardening Agent)

1. Aldehyde-type crosslinking agents:

Formaldehyde is most commonly used. Dialdehyde can also form an effective crosslinking and examples thereof include glyoxal and succinaldehyde with glutaraldehyde being more effective. Various aromatic dialdehydes of diglycoaldehyde, dialdehyde starch, and dialdehyde derivatives of plant gum may also be used for the crosslinking in the present invention.

2. N-Methylol compounds and other protected aldehyde crosslinking agents:

N-methylol compounds obtained by the condensation of formaldehyde with aliphatic linear or cyclic amide of various types, urea or a nitrogen-containing heterocyclic ring. Specific examples thereof include 2,3-dihydroxydioxane, acetic acid esters of dialdehyde and hemiacetal thereof, and 2,5-methoxytetrahydrofuran.

3. Ketone crosslinking agents:

Diketone and quinone compounds. Examples of well-known diketones include 2,3-butadione and $CH_3COCOCH_3$, and examples of well-known quinones include p-benzoquinone.

4. Sulfonic acid esters and sulfonyl halides:

Representative examples of these compounds include bis(sulfonyl chlorides) and bis(sulfonyl fluorides).

5. Active halogen compounds:

Compounds having two or more active halogen atoms. Representative examples of the compound include simple bis-α-chloro or bis-α-bromo derivatives, bis(2-chloroethylurea), bis(2-chloroethyl)sulfone and phosphoramidic halide.

6. Epoxides:

Representative examples of this compound include butadiene dioxide.

7. Active olefins:

A large number of compounds having two or more double bonds, particularly unsubstituted vinyl groups activated by adjacent electron-withdrawing groups are effective as a crosslinking agent of gelatin. Examples of this compound include divinyl ketone, resorcinol bis(vinyl sulfonate), 4,6-bis(vinyl sulfonate), 4,6-bis(vinylsulfonyl)-m-xylene, bis(vinylsulfonylalkyl)ether or amine, 1,3,5-triacryloylhexahydro-s-triazine, diacrylamide and 1,3-bis(acryloyl)urea.

8. s-Triazine type compounds:

With respect to the compounds of this type, JP-B-47-6151, JP-B-47-33380, JP-B-54-25411 and JP-A-56-130740 describe cyanur chloride-type hardening agents in detail. Also, the compounds having a structure analogous to the cyanur chloride-type hardening agent described in JP-B-53-2726, JP-A-50-61219 and JP-A-56-27135 are useful.

9. Vinyl sulfone-type compounds:

The vinyl sulfone-type hardening agent is described in detail, for example, in JP-B-47-24259, JP-B-50-35807, JP-A-49-24435, JP-A-53-41221 and JP-A-59-18944.

10. Carbamoyl ammonium salts:

The carbamoyl ammonium salt hardening agent is described in detail in JP-B-56-12853, JP-B-58-32699, JP-A-49-51945, JP-A-51-59625 and JP-A-61-9641.

11. Compounds described in Belgian Patent 825,726.

12. Amidinium salt-type compounds:

The amidinium salt-type hardening agent is described in detail in JP-A-60-225148.

13. Carbodiimide-type compounds:

The carbodiimide-type hardening agent is described in detail in JP-A-51-126125 and JP-A-52-48311.

14. Pyridinium base-type compounds:

The pyridinium base-type hardening agent is described in detail in JP-B-58-50699, JP-A-57-44140 and JP-A-57-46538.

15. Pyridinium salt-type compounds:

The pyridinium salt-type hardening agent is described in detail in JP-A-52-54427.

In addition to these compounds, the compounds described in JP-A-50-38540, JP-A-52-93470, JP-A-56-43353, JP-A-58-113929 and U.S. Pat. No. 3,321,313 can also be used as the hardening agent for use in the present invention, In the process of forming and/or growing the grains, a metal ion can be doped to the silver halide grain for use in the present invention. The doped site is inside and/or surface. Examples of the metal dopant which can be used include iron salt, cobalt salt, nickel salt, ruthenium salt, cadmium salt, zinc salt, lead salt, thallium salt, erbium salt, bismuth salt, iridium salt, indium salt, rhodium salt and complex salts thereof containing an inorganic compound and/or an organic compound as the ligand. The inorganic compound ligand is preferably CN or a halogen.

The silver halide grain may have a dislocation line within the grain. The technique of introducing a dislocation line into a silver halide grain under control is described in JP-A-63-220238. According to this patent publication, a specific high iodide phase is provided inside a tabular silver halide grain having an average grain size/grain thickness ratio of 2 or more and a phase having an iodide content lower than that of the high iodide phase is provided to cover the outer side of the high iodide phase, whereby dislocation can be introduced. By this introduction of dislocation, effects such as increase in sensitivity, improvement of storability, improvement of latent image stability and reduction in pressure fogging, can be obtained. In the invention of this patent publication, the dislocation is introduced mainly into the edge part of a tabular grain. U.S. Pat. No. 5,238,796 describes a tabular grain in which dislocation is introduced into the center part. Furthermore, JP-A-4-348337 discloses a regular crystal grain having dislocation inside the grain and according to this patent publication, an epitaxy of silver chloride or silver chlorobromide is produced on a regular crystal grain and the epitaxy is subjected to physical ripening and/or halogen conversion, whereby the dislocation can be introduced. By this introduction of dislocation, effects such as increase in the sensitivity and decrease in the pressure fogging can be obtained. The dislocation line in a silver halide grain can be observed by a direct method using a transmission electron microscope at a low temperature described, for example, in J. F. Hamilton, *Photo. Sci. Eng.,* 1967, 11, 57, or T. Shinozawa, *J. Soc. Photo. Sci. JAPAN,* 1972, 35, 213. More specifically, silver halide grains are taken out from an emulsion while taking care not to apply a pressure sufficiently high to generate dislocation, then placed on a mesh for the observation through an electron microscope, and observed by a transmission method while laying the sample in the cooled state so as to prevent damage (printout) by an electron beam. At this time, as the grain thickness is larger, the electron beam becomes more difficult to transmit and therefore, a high-pressure type (200 keV or more for the thickness of 0.25 $\mu$m) electron microscope is preferably used to observe the grains more clearly. From the thus-obtained photograph of grains, the site and the number of dislocation lines of individual grains viewed from the surface perpendicular to the main plane can be determined. The present invention is effective in the case where 50% or more by number of silver halide grains have one or more dislocation line per one grain.

Using the silver halide grain prepared in the present invention as the host grain, epitaxial grains may be formed. The technique on this formation is described, for example, in J. E. Masksky, *J. Img. Sci.,* 32, 166 (1988), JP-A-64-26837, JP-A-64-26838, JP-A-64-26840, JP-A-1-179140, U.S. Pat. No. 4,865,962, JP-A-49-68595, JP-A-8-171162, JP-A-2000-2959 and U.S. Pat. No. 5,604,086. Furthermore, using the above-described grain as the core, internal latent image-type grains may be formed or by laminating a silver halide layer different in the halogen composition from the above-described grain, so-called core/shell grains may be used. The technique on these grains are described in JP-A-59-133542, JP-A-63-151618 and U.S. Pat. Nos. 3,206,313, 3,317,322, 3,367,778, 3,761,276 and 4,269,927.

In the subsequent step, the silver halide grain emulsion is subjected to a step of removing excess salts generated by the addition of $Ag^+$ salt and $X^-$ salt. At this time, gelatin may be added before water washing so as to promote the precipitation of grains. The water washing may be performed using a conventionally known method, namely, [1] a noodle water washing method, [2] a method of adding a precipitant to precipitate the emulsion and washing the emulsion with water, [3] a method of using a modified gelatin such as phthalated gelatin, [4] an ultrafiltration method (this method is described in detail in G. F. Duffin, *Photographic Emulsion Chemistry,* The Focal Press, London (1966), or the like.

In the production of a silver halide emulsion according to the present invention, the additives which can be added from the grain formation until the coating are not particularly limited. Also, a combination use with any known technique may be employed. The techniques thereon are described in the following publications. In order to promote the growth in the process of crystal formation or to effectively perform the chemical sensitization at the time of grain formation and/or chemical sensitization, a silver halide solvent may be used. The silver halide solvent which is often used is water-soluble thiocyanate, ammonia, thioether or thiourea. Examples of the silver halide solvent include thiocyanates (e.g., those described in U.S. Pat. Nos. 2,222,264, 2,448,534 and 3,320,069), ammonia, thioether compounds (e.g., those described in U.S. Pat. Nos. 3,271,157, 3,574,628, 3,704,130, 4,297,439 and 4,276,347), thione compounds (e.g., those described in JP-A-53-144319, JP-A-53-82408 and JP-A-55-77737), amine compounds (e.g., those described in JP-A-54-100717), thiourea derivatives (e.g., those described in JP-A-55-2982), imidazoles (e.g., those described in JP-A-54-100717) and substituted mercaptotetrazoles (e.g., those described in JP-A-57-202531).

The silver halide emulsion for use in the present invention may be produced using any conventionally known method. That is, an aqueous silver salt solution and an aqueous halogen salt solution are added to a reactor holding an aqueous gelatin solution while stirring efficiently. Specific examples of the preparation method include the methods described in P. Glafkides, *Chemie et Phisique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). More specifically, any of an acidic process, a neutral process and an ammonia process may be used, and the form for reacting a soluble silver salt and a soluble halogen salt may be any of a single jet method, a double jet method and a combination thereof. A so-called controlled double jet method of keeping the liquid phase for forming silver halide at a constant pAg, which is one form of the double jet method, may also be used. The grains are preferably grown rapidly within the range of not exceeding the critical supersaturation degree by using a method of changing the addition rate of silver nitrate or an aqueous alkali halide solution according to the grain growth speed described in British Patent 1,535,016, JP-B-48-36890 and JP-B-52-16364, or a method of changing the concentration of the aqueous solution described in U.S. Pat. No. 4,242,445 and JP-A-55-158124. These methods are preferred because renucleation does not occur and silver halide grains uniformly grow.

In place of adding a silver salt solution and a halogen salt solution to a reactor, fine grains previously prepared may be added to the reactor to cause nucleation and/or grain growth and thereby obtain silver halide grains and this method is described in JP-A-1-183644, JP-A-1-183645, U.S. Pat. No. 4,879,208, JP-A-2-44335, JP-A-2-43534 and JP-A-2-43535. According to this method, the halogen ion distribution within the emulsion grain crystal can be made highly uniform and preferred photographic properties can be achieved. Furthermore, emulsion grains having various structures can be used in the present invention. A so-called core-shell double structure grain consisting of a grain inside (core) and an outside (shell), a triple structure grain disclosed in JP-A-60-222844 or a greater multiple structure grain may be used. When an emulsion grain is intended to have a structure in the inside thereof, not only a grain having the above-described wrapping structure but also a grain having a so-called junction structure may be prepared. Examples thereof are disclosed in JP-A-59-133540, JP-A-58-108526, EP-A-199290, JP-B-58-24772 and JP-A-59-16254. The joined crystal may have a composition different from the host crystal and can be grown to join to the edge or corner part or on the plane part of the host crystal.

Whichever the halogen composition of the host crystal is uniform or has a core-shell structure, the joined crystal can be formed. In the case of the junction structure, silver halide and another silver halide can of course be combined but if a combination and junction structure with silver halide can be formed, a silver salt compound not having a rock-salt structure, such as silver rhodanide and silver carbonate, may also be used.

In the case of a silver iodobromide grain having the above-described structure, for example, in a core-shell type grain, the silver iodide content may be high in the core part and low in the shell part or on the contrary, the silver iodide content may be low in the core part and high in the shell part. Similarly, in the case of a grain having a junction structure, the grain may comprise a host crystal having a high silver iodide content and a joined crystal having a relatively low silver iodide content or the grain may have a reverse relationship. The boundary part between the portions different in the halogen composition of a grain having the above-described structure may be clear or may be unclear by forming a mixed crystal using difference in the composition or furthermore, a continuous structural change may be positively provided. The silver halide emulsion for use in the present invention may be subjected to a treatment of giving rounded grains disclosed in EP-B-0096727 and EP-B-0064412 or to a surface modification disclosed in DE-C-2306447 and JP-A-60-221320.

In the present invention, the chemical sensitization may be performed using chalcogen sensitization (for example, sulfur sensitization, selenium sensitization and tellurium sensitization), noble metal sensitization and reduction sensitization individually or in combination.

In the sulfur sensitization, a labile sulfur compound is used and examples of the labile sulfur compound which can be used include those described in P. Glafkides, *Chemie et Physique Photographique,* 5th ed., Paul Montel (1987), and *Research Disclosure,* Vol. 307, No. 307105. Specific examples thereof include known sulfur compounds such as thiosulfates (e.g., hypo), thioureas (e.g., diphenyl-thiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphinesulfides (e.g., trimethylphosphinesulfide), thiohydantoins, 4-oxo-oxazolidine-2-thiones, dipolysulfides (e.g., dimorpholinedisulfide, cystine, hexathiocane-thione), mercapto compounds (cysteine), polythionates and elemental sulfur. Active gelatin may also be used.

In the selenium sensitization, a labile selenium compound is used and examples of the labile selenium compound which can be used include those described in JP-B-43-13489, JP-B-44-15748, JP-A-4-25832 and JP-A-4-109240. Specific examples thereof include colloidal metal selenium, selenoureas (e.g., N,N-dimethylselenourea, trifluoromethylcarbonyl-trimethylselenourea, acetyl-trimethylselenourea), selenoamides (e.g., selenoacetamide, N,N-diethylphenylselenoamide), phosphine selenides (e.g., triphenylphosphineselenide, pentafluorophenyltriphenylphosphineselenide), selenophosphates (e.g., tri-p-tolyl-selenophosphate, tri-n-butylselenophosphate), selenoketones (e.g., selenobenzophenone), isoselenocyanates, selenocarboxylic acids, selenoesters and diacyl selenides. In addition, non-labile selenium compounds such as selenious acid, potassium selenocyanate, selenazoles and selenides described in JP-B-46-4553 and JP-B-52-34492 may also be used.

In the tellurium sensitization, a labile tellurium compound is used and examples of the labile tellurium compound which can be used include those described in Canadian Patent 800,958 and British Patents 1,295,462 and 1,396,696. Specific examples thereof include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxy-diphenylphophinetelluride), diacyl(di)tellurides (e.g., bis(diphenylcarbamoyl)ditelluride, bis(N-phenyl-N-methyl-carbamoyl)ditelluride, bis(N-phenyl-N-methylcarbamoyl)-telluride, bis(ethoxycarbonyl)telluride), isotellurocyanates, telluroamides, tellurohydrazides, telluroesters (e.g., butylhexyltelluroester), telluroketones (e.g., telluroacetophenone), colloidal tellurium, (di)tellurides and other tellurium compounds (e.g., potassium telluride, sodium telluropentathionate).

In the noble metal sensitization, a salt of noble metals such as gold, platinum, palladium and iridium is used and examples of the noble metal salt which can be used include those described in P. Glafkides, *Chemie et Phisigue Photographique,* 5th ed., Paul Montel (1987) and *Research Disclosure,* Vol. 307, No. 307105. In particular, gold sensitization is preferred. Specific examples of the gold salt which can be used include chloroauric acid, potassium chloroaurate, potassium aurithiocyanate, gold sulfide, gold selenide and the gold compounds described in U.S. Pat. Nos. 2,642,361, 5,049,484 and 5,049,485. In the reduction sensitization, a reducing compound is used and examples of the known reducing compounds include those described in P. Glafkides, *Chemie et Phisigue Photographigue,* 5th ed., Paul Montel, (1987), and *Research Disclosure,* Vol. 307, No. 307105. Specific examples thereof include aminoiminomethanesulfinic acid (also called thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfites, aldehyde compounds and hydrogen gas. The reduction sensitization may also be performed in an atmosphere of high pH or excess silver ion (so-called silver ripening).

These chemical sensitization treatments may be used individually or in combination of two or more thereof and when used in combination, a combination of chalcogen sensitization and gold sensitization is preferred. The reduction sensitization is preferably performed at the time of forming silver halide grains. The amount used of the chalcogen sensitizer for use in the present invention is approximately from $10^{-8}$ to $10^{-2}$ mol, preferably from $10^{-7}$ to $5\times10^{-3}$ mol, per mol of silver halide, though the amount used varies depending on the silver halide grain used and the chemical sensitization conditions. The amount used of the noble metal sensitizer for use in the present invention is approximately from $10^{-7}$ to $10^{-2}$ mol per mol of silver halide. In the present invention, the conditions for the chemical sensitization are not particularly limited, however, the pAg is from 6 to 11, preferably from 7 to 10, the pH is preferably from 4 to 10, and the temperature is preferably from 40 to 95° C., more preferably from 45 to 85° C.

The silver halide emulsion is usually subjected to spectral sensitization. The spectral sensitization dye is usually a methine dye. The methine dye includes a cyanine dye, a merocyanine dye, a complex cyanine dye, a complex merocyanine dye, a holopolar cyanine dye, a hemicyanine dye, a styryl dye and a hemioxonol dye. The basic heterocyclic ring applied to these dyes may be any ring usually used for cyanine dyes. Examples of the basic heterocyclic ring which can be used include a pyrroline ring, an oxazoline ring, a thiazoline ring, a pyrrole ring, an oxazole ring, a thiazole ring, a selenazole ring, an imidazole ring, a tetrazole ring and a pyridine ring. In addition, a ring obtained by condensing an alicyclic hydrocarbon ring or an aromatic hydrocarbon ring to a heterocyclic ring may also be used. Examples of the condensed ring include an indolenine ring, a benzindolenine ring, an indole ring, a benzoxazole ring, a naphthoxazole ring, a benzothiazole ring, a naphthothiazole ring, a benzimidazole ring, a benzoselenazole ring and a quinoline ring. On the carbon atom of these rings, a substituent may be bonded. The merocyanine dye or complex merocyanine dye may contain a 5- or 6-membered heterocyclic ring having a ketomethylene structure. Examples of such a heterocyclic ring include a pyrazolin-5-one ring, a thiohydantoin ring, a 2-thiooxazolidine-2,4-dione ring, a thiazolidine-2,4-dione ring, a rhodanine ring and a thiobarbituric acid ring.

The amount of the sensitizing dye added is preferably from 0.001 to 100 mmol, more preferably from 0.01 to 10 mmol, per mol of silver halide. The sensitizing dye is preferably added during the chemical sensitization or before the chemical sensitization (for example, during the grain formation or physical ripening). Together with the sensitizing dye, a dye which itself has no spectral sensitization effect or a substance which absorbs substantially no visible light, but which exhibits supersensitization may be added to the silver halide emulsion. Examples of such a dye or substance include aminostil compounds substituted by a nitrogen-containing heterocyclic group (those described in U.S. Pat. Nos. 2,933,390 and 3,635,721), aromatic organic acid-formaldehyde condensates (those described in U.S. Pat. No. 3,743,510), cadmium salts and azaindene compounds. The combination of a sensitizing dye with the above-described dye or substance is described in U.S. Pat. Nos. 3,615,613, 3,615,641, 3,617,295 and 3,635,721.

The silver halide emulsion may contain various compounds for the purpose of preventing fogging during the production, storage or photographic processing of the light-sensitive material or for stabilizing the photographic capabilities. Examples of these compounds include azoles (e.g., benzothiazolium salts, nitroimidazoles, triazoles, benzotriazoles, benzimidazoles (particularly nitro- or halogen-substitution products)); heterocyclic mercapto compounds (e.g., mercaptothiazoles, mercaptobenzothiazoles, mercaptobenzimidazoles, mercaptothiadiazoles, mercaptotetrazoles (particularly l-phenyl-5-mercaptotetrazole), mercaptopyrimidines); the above-described heterocyclic mercapto compounds having a water-soluble group such as carboxyl group or sulfone group; thioketo compounds (e.g., oxazolinethione); azaindenes (e.g., tetraazaindenes (particularly 4-hydroxy-substituted (1,3,3a,7)tetraazaindenes)); benzenethiosulfonic acids; and benzenesulfinic acids. These compounds are generally known as an antifoggant or a stabilizer. The antifoggant or stabilizer is usually added after the application of chemical sensitization, however, the timing may be selected from the period during the chemical sensitization and the period before the initiation of chemical sensitization. More specifically, in the process of forming silver halide emulsion grains, the antifoggant or stabilizer may be added during the addition of a silver salt solution, between the addition of a silver salt solution and the initiation of chemical sensitization or during the chemical sensitization (within the chemical sensitization time, preferably within a time period from the initiation until 50% of the chemical sensitization time, more preferably until 20% the chemical sensitization time).

The layer structure of the silver halide photographic material is not particularly limited. However, in the case of a color photographic material, a multilayer structure is used for separately recording blue light, green light and red light. Each silver halide emulsion layer may consist of two layers of high-speed layer and low-speed layer. Practical examples of the layer structure include the followings (1) to (6).

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S wherein B is a blue-sensitive layer, G is a green-sensitive layer, R is a red-sensitive layer, H is a highest-speed layer, M is a medium-speed layer, L is a low-speed layer, S is a support and CL is an interlayer effect-imparting layer. The light-insensitive layers such as protective layer, filter layer, interlayer, antihalation layer and subbing layer are omitted. The high-speed layer and the low-speed layer having the same color sensitivity may be reversed. The layer structure (3) is described in U.S. Pat. No. 4,184,876, the layer structure (4) is described in RD-22534, JP-A-59-177551 and JP-A-59-177552, and the layer structures (5) and (6) are described in JP-A-61-34541. Of these, the layer structures (1), (2) and (4) are preferred.

The silver halide emulsion of the present invention can be used for black-and-white silver halide photographic light-sensitive materials (e.g., X-ray light-sensitive material, lith-type light-sensitive material, negative film for black-and-white photographing), color photographic light-sensitive materials (e.g., color negative film, color reversal film, color paper), diffusion transfer light-sensitive materials (e.g., color diffusion transfer element, silver salt diffusion transfer element) and heat-developable light-sensitive materials (black-and-white, color).

The silver halide emulsion of the present invention is preferably used for a multilayer color light-sensitive material because its photographic performance can be more satisfactorily brought out. The silver halide emulsion of the present invention may be used in any light-sensitive layer but is preferably used in a red-sensitive layer or a green-sensitive layer, more preferably in a red-sensitive layer.

Various additives (e.g., binder, chemical sensitizer, spectral sensitizer, stabilizer, gelatin hardening agent, surfactant, antistatic agent, polymer latex, matting agent, color coupler, ultraviolet absorbent, discoloration inhibitor, dyestuff) for the silver halide emulsion, the support of the photographic material, and the processing method (e.g., coating method, exposure method, development method) of the photographic material are described in *Research Disclosure,* Vol. 176, No. 17643 (RD-17643), ibid., Vol. 187, No. 18716 (RD-18716), and ibid., Vol. 225, No. 22534 (RD-22534).

The pertinent portions in these *Research Disclosures* are shown in the table below (Table 1).

TABLE 1

| Kinds of Additives | RD-17643 | RD-18716 | RD-22534 |
|---|---|---|---|
| 1. Chemical sensitizer | Page 23 | page 648, right column | page 24 |
| 2. Sensitivity enhancer | Ditto | | |

TABLE 1-continued

| Kinds of Additives | RD-17643 | RD-18716 | RD-22534 |
|---|---|---|---|
| 3. Spectral sensitizer, supersensitizer | pages 23 to 24 | page 648, right column to page 649, right column | pages 24 to 28 |
| 4. Brightening agent | Page 24 | | |
| 5. Antifoggant, stabilizer | pages 24 and 25 | page 649, right column | pages 24 and 31 |
| 6. Light absorbent, filter dye, UV absorbent | pages 25 to 26 | page 649, right column to page 650, left column | |
| 7. Stain inhibitor | Page 25, right column | page 650, left to right columns | |
| 8. Dye Image Stabilizer | Page 25 | | page 32 |
| 9. Hardening agent | Page 26 | page 651, left column | page 28 |
| 10. Binder | Page 26 | page 651, left column | |
| 11. Plasticizer, lubricant | Page 27 | page 650, right column | |
| 12. Coating aid, surfactant | pages 26 and 27 | page 650, right column | |
| 13. Antistatic agent | Page 27 | page 650, right column | |
| 14. Color coupler | Page 25 | page 649 | page 31 |

The gelatin hardening agent is preferably, for example, an active halogen compound (e.g., 2,4-dichloro-6-hydroxy-1,3,5-triazine or a sodium salt thereof) or an active vinyl compound (e.g., 1,3-bisvinylsulfonyl-2-propanol, 1,2-bis(vinylsulfonylacetamido)ethane, vinyl polymer having a vinylsulfonyl group on the side chain), because hydrophilic colloid such as gelatin can be rapidly hardened and stable photographic properties are obtained. Also, N-carbamoyl pyridinium salts (e.g., (1-morpholinocarbonyl-3-pyridinio) methanesulfonate) and haloamidinium salts (e.g., 1-(1-chloro-1-pyridinomethylene)pyrrolidinium-2-naphthalene sulfonate) are excellent because of their high hardening rate.

The color photographic material can be developed by an ordinary method described in *RD*, No. 17643, pages 28 and 29, and ibid., No. 18716, page 651, left to right columns. The color photographic light-sensitive material is usually subjected to a water washing treatment or a stabilization treatment after the developing, bleach-fixing or fixing treatment. The water washing is generally performed in a countercurrent washing system using two or more tanks for the purpose of saving water. A representative example of the stabilization treatment in place of water washing is the multistage countercurrent stabilization treatment described in JP-A-57-8543.

The present invention is described below in greater detail by referring to Examples, but the present invention should not be construed as being limited to these examples.

EXAMPLE 1

Emulsion 1-A (Comparison):

In the process shown in FIG. 1, tabular grains were prepared as follows. In this example, a method of performing the nucleation in a reactor and performing the grain growth by adding fine grains prepared in a mixing vessel to the reactor is described. To a reactor 1, 1.0 liter of water, 0.5 g of ossein gelatin (methionine content: 5 $\mu$mol/g) subjected to an oxidation treatment and 0.38 g of KBr were added and dissolved and to the resulting solution kept at 20° C. in the reactor 1, 20 ml of an aqueous 0.29 M silver nitrate solution and 20 ml of an aqueous 0.29 M KBr solution were added over 40 seconds (nucleation).

After the temperature was elevated from 20° C. to 75° C. over 29 minutes, the obtained emulsion was left standing for 2 minutes. On the way of elevating the temperature, 495 ml of a 10 wt % ossein gelatin solution with 95% of amino groups being trimellitated and KBr were added to adjust the pBr of the emulsion in the reactor 1 to 2.1 (ripening).

Thereafter, 942 ml of an aqueous 0.53 M silver nitrate solution and 942 ml of an aqueous 0.59M KBr solution containing 5 wt % of low molecular weight ossein gelatin (average molecular weight: 20,000) were added to the mixing vessel 10 each at a constant rate over 42 minutes. The fine grain emulsion produced in the mixing vessel 10 were continuously added to the reactor 1 (growth).

The mixing vessel 10 used was a mixing vessel described in JP-A-10-239787, the volume of the mixing vessel was 0.5 ml, two stirring blades were used, the revolution number in stirring was 1,000 rotations for the upper blade and 2,000 rotations for the lower blade, and the stirring blades were rotated in the reverse direction from each other. The properties of the obtained tabular grains are shown in Table 2.

Emulsion 1-B (Comparison):

Emulsion 1-B was prepared in the same manner as Emulsion 1-A except that 10 ml of an aqueous solution containing 0.02 M Crystal Habit-Controlling Agent (1) was added to the reactor 1 three minutes after the completion of nucleation and 150 ml of an aqueous solution containing 0.02 M Crystal Habit-Controlling Agent (2) was added to the reactor 1 over 42 minutes during the grain growth. The properties of the obtained tabular grains are shown in Table 2.

Crystal Habit-Controlling Agent (1)

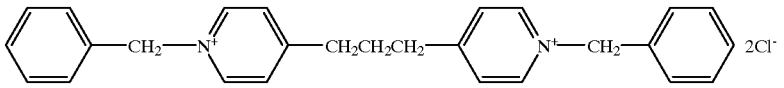

Crystal Habit-Controlling Agent (2)

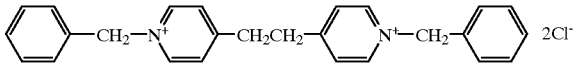

Emulsion 1-C (Invention):

Emulsion 1-C was prepared in the same manner as Emulsion 1-B except that 200 ml of a solution containing 10 wt % of high molecular weight ossein gelatin (components having a molecular weight of 280,00: 22.3%) crosslinked by Crosslinking Agent (1) was added to the reactor 1 before the growth of tabular grains.

Figure 2:
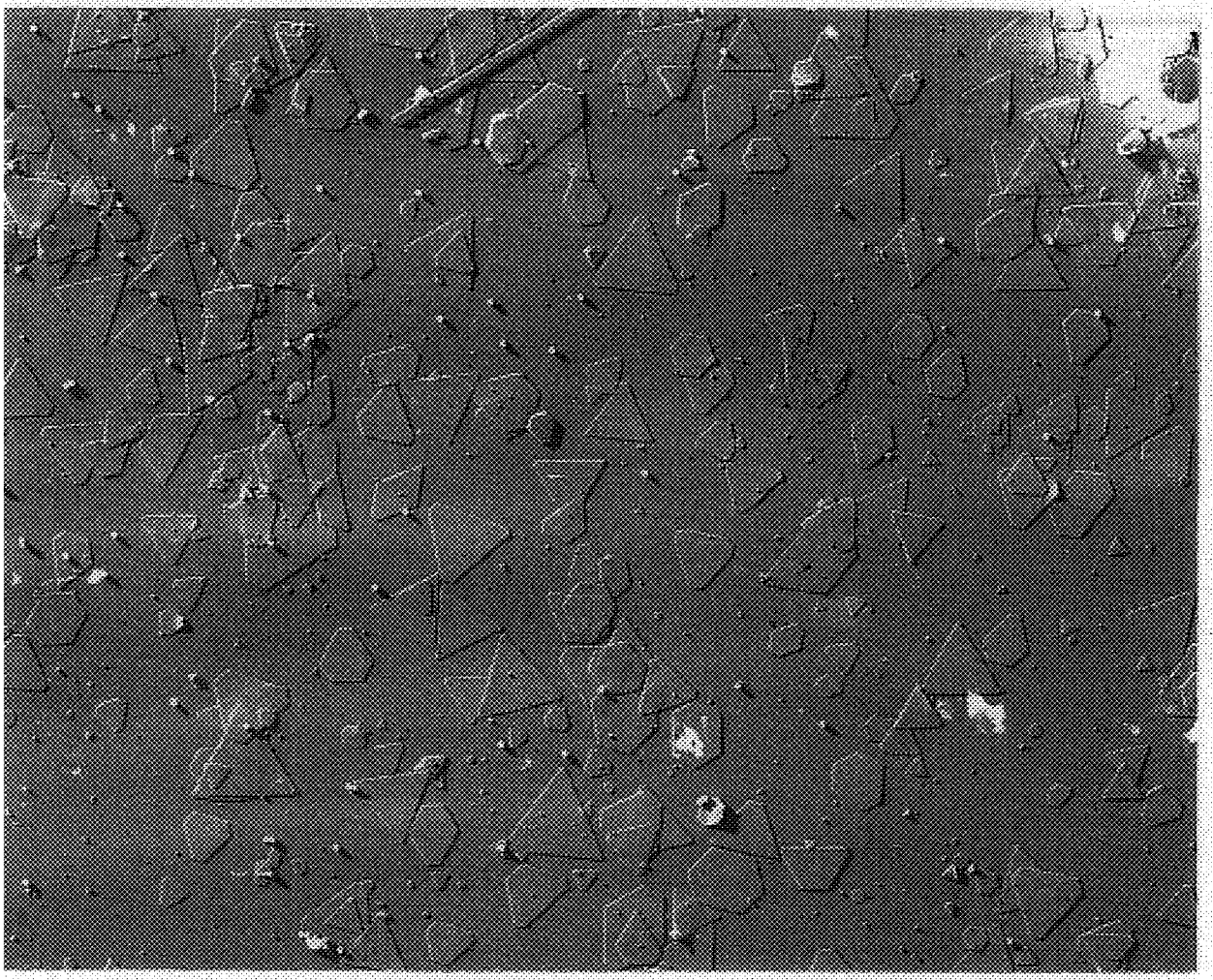
FIG. 2 is an electron microphotograph showing the structure of silver halide grains.

FIG. 2 is an electron microphotograph showing the structure of silver halide grains of Emulsion 1-C according to the present invention. In the photograph, the diameter of a spherical latex is 0.2 $\mu$m.

Crosslinking Agent (1)

$$CH_2{=}CHSO_2CH_2CONH{-}(CH_2)_2{-}NHCOCH_2SO_2CH{=}CH_2$$

Emulsion 1-D (Invention):

Emulsion 1-D was prepared in the same manner as Emulsion 1-B except that 200 ml of a solution containing 10 wt % of high molecular weight ossein gelatin (components having a molecular weight of 280,000: 37.0%) crosslinked by Crosslinking Agent (1) was added to the reactor 1 before the growth of tabular grains.

Emulsion 2-A (Comparison):

In the process shown in FIG. 1, tabular grains were prepared as follows. In this example, a method of performing the nucleation in a reactor and performing the grain growth by adding fine grains prepared in a mixing vessel to the reactor is described. To a reactor 1, 1.0 liter of water, 0.5 g of ossein gelatin (methionine content: 5 mmol/g) subjected to an oxidation treatment and 0.38 g of KBr were added and dissolved and to the resulting solution kept at 20° C. in the reactor 1, 20 ml of an aqueous 0.29 M silver nitrate solution and 20 ml of an aqueous 0.29 M KBr solution were added over 40 seconds (nucleation).

After the temperature was elevated from 20° C. to 75° C. over 29 minutes, the obtained emulsion was left standing for 2 minutes. On the way of elevating the temperature, 495 ml of a 10 wt % ossein gelatin solution with 95% of amino groups being trimellitated and KBr were added to adjust the pBr of the emulsion in the reactor 1 to 2.1 (ripening).

Thereafter, 942 ml of an aqueous 0.53 M silver nitrate solution and 942 ml of an aqueous 0.59M KBr solution were added by the double jet method each at a constant rate over 42 minutes (growth).

The properties of the obtained tabular grains are shown in Table 2.

Emulsion 2-B (Comparison):

Emulsion 2-B was prepared in the same manner as Emulsion 2-A except that 10 ml of an aqueous solution containing 0.02 M Crystal Habit-Controlling Agent (1) was added to the reactor 1 three minutes after the completion of nucleation and 150 ml of an aqueous solution containing 0.02 M Crystal Habit-Controlling Agent (2) was added to the reactor 1 over 42 minutes during the grain growth. The properties of the obtained tabular grains are shown in Table 2.

Emulsion 2-C (Invention):

Emulsion 2-C was prepared in the same manner as Emulsion 2-B except that 200 ml of a solution containing 10 wt % of high molecular weight ossein gelatin (components having a molecular weight of 280,000: 22.3%) crosslinked by Crosslinking Agent (1) was added to the reactor 1 before the growth of tabular grains.

Emulsion 2-D (Invention):

Emulsion 2-D was prepared in the same manner as Emulsion 2-B except that 200 ml of a solution containing 10 wt % of high molecular weight ossein gelatin (components having a molecular weight of 280,000: 37.0%) crosslinked by Crosslinking Agent (1) was added to the reactor 1 before the growth of tabular grains.

In each of Emulsions 1-B, 1-C, 1-D, 2-B, 2-C and 2-D, tabular grains satisfying the requirements (i) to (iii) described in claim 1 occupied 50% or more, and the average thickness and average equivalent-circle diameter thereof were as shown in Table 2.

TABLE 2

| Emulsion | Average Tabular Thickness (μm) | Coefficient of Variation in Tabular Thickness (%) | Equivalent-Circle Diameter (μm) | |
|---|---|---|---|---|
| 1-A | 0.051 | 17 | 1.2 | Comparison |
| 1-B | 0.036 | 57 | 1.0 | Comparison |
| 1-C | 0.033 | 22 | 1.3 | Invention |
| 1-D | 0.033 | 18 | 1.3 | Invention |
| 2-A | 0.072 | 30 | 1.2 | Comparison |
| 2-B | 0.043 | 53 | 1.2 | Comparison |
| 2-C | 0.040 | 33 | 1.3 | Invention |
| 2-D | 0.040 | 30 | 1.3 | Invention |

In each emulsion, 70% or more of the projected area of all silver halide grains is occupied by tabular grains and the measured values of average tabular thickness and average equivalent-circle diameter of the tabular grains are shown in Table 2. The coefficient of variation is a value determined by dividing the standard deviation of the tabular thickness by the average tabular thickness and multiplying the obtained value by 100. It is seen from the results in Table 2 that when Emulsions 1-C and 1-D of the present invention are compared with Emulsions 1-A, 2-C, 2-D and 2-A, tabular grains reduced in the tabular thickness according to the present invention are formed in Emulsions 1-C, 1-D, 2-C and 2-D prepared by adding an aqueous solution of Crystal Habit-Controlling Agent (1) or (2). When Emulsions 1-C, 1-D and 1-B are compared with Emulsions 2-C, 2-D and 2-B, tabular grains reduced in the coefficient of variation in the tabular thickness according to the present invention are formed in Emulsions 1-C, 1-D, 2-C and 2-D prepared by adding a high molecular weight ossein gelatin (high molecular weight components: 22.3% or 37.0%).

Each nucleus emulsion shown in Table 2 was optimally processed by chemical sensitization and spectral sensitization and the photographic properties are compared.

Emulsions 1-C and 1-D and Emulsions 2-C and 2-D showed, as compared with respective comparative emulsions, good performance in both sensitivity and fog and improvements in the softening of photographic properties and accordingly in the sharpness.

According to the present invention, a tabular grain emulsion more reduced in the thickness, favored with monodispersivity in the thickness and showing good performance in the sensitivity and fog can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one spectrally sensitized silver halide emulsion characterized in that 50% or more of the projected area of all silver halide grains comprises tabular silver halide grains satisfying all of the following requirements (i) to (iii) and the coefficient of variation in the thickness of the tabular silver halide grains is less than 40%:

(i) to have a grain thickness of less than 0.05 μm and an equivalent-circle diameter of 0.6 μm or more;

(ii) to be silver iodobromide or silver chloroiodobromide having a silver bromide content of 70 mol % or more;

(iii) to be a tabular silver halide grain having two parallel main planes comprising a (111) face.

2. The silver halide photographic light-sensitive material as claimed in claim 1, wherein the coefficient of variation in the thickness of said tabular silver halide grains is less than 30%.

3. The silver halide photographic light-sensitive material as claimed in claim 1, wherein the coefficient of variation in the thickness of said tabular silver halide grains is less than 20%.

4. The original silver halide photographic light-sensitive material as claimed in claim 1, wherein the average equivalent-circle diameter of said tabular silver halide grains is 1.0 $\mu$m or more.

5. A method for preparing a silver halide emulsion characterized in that 50% or more of the projected area of all silver halide grains comprises tabular silver halide grains satisfying all of the following requirements (i) to (iii) and the coefficient of variation in the thickness of the tabular silver halide grains is less than 40%:

(i) to have a grain thickness of less than 0.05 pm and an equivalent-circle diameter of 0.6 $\mu$m or more;

(ii) to be silver iodobromide or silver chloroiodobromide having a silver bromide content of 70 mol % or more;

(iii) to be a tabular silver halide grain having two parallel main planes comprising a (111) face;

wherein said tabular silver halide grains are prepared by a method wherein a crystal habit-controlling agent comprising a compound selected from the compounds represented by the following formulae (I), (II) and (LU) is not present in the reactor at the time of nucleation but is allowed to be present in the reactor at the time of physical ripening and growing:

(I)

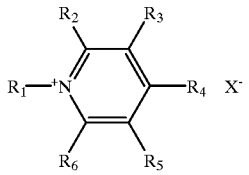

wherein $R_1$ represents an alkyl group, an alkenyl group or an aralkyl group, $R_2$, $R_3$, $R_1$, $R_5$ and $R_6$ each represents a hydrogen atom or a substituent, each of the pairs $R_2$ and $R_3$, $R_3$ and $R_1$, $R_4$ and $R_5$, and $R_5$ and $R_6$ may form a condensed ring, provided that at least one of $R_2$, $R_3$, $R_4$, $R_5$ and $R_6$ represents an aryl group, and $X^{31}$ represents a counter anion;

(II)

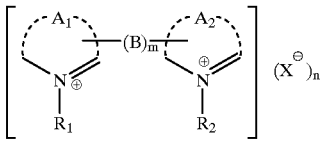

(III)

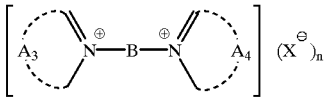

wherein $A_1$, $A_2$, $A_3$ and $A_4$, which may be the same or different, each represents a nonmetallic atom group necessary for completing the nitrogen-containing heterocyclic ring, B represents a divalent linking group, m represents 0 or 1, $R^1$ and $R^2$ each represents an alkyl group, X represents an anion, and n represents 0, 1 or 2, provided that when an inner salt is formed, n is 0 or 1; and said tabular silver halide grains are produced in the presence of a lime-processed ossein gelatin satisfying the requirement (a):

(a) the high molecular weight components having a molecular weight of about 280,000 or more occupy from 5 to 50% based on the total molecular weight of the gelatin and the low molecular weight components having a molecular weight of about 100,000 or less occupy 55% or less based on the total molecular weight of the gelatin.

6. The method for preparing a silver halide emulsion as claimed in claim 5, wherein said tabular silver halide grains are produced by a method wherein the nucleation and/or growth is performed by feeding a silver halide fine grain emulsion to the reactor.

* * * * *